US007862118B2

(12) United States Patent
Sims, Jr.

(10) Patent No.: US 7,862,118 B2
(45) Date of Patent: Jan. 4, 2011

(54) INFANT SEAT ROCKER

(76) Inventor: Dewey M. Sims, Jr., 38744 Laurenwood St., Wayne, MI (US) 48184

( * ) Notice: Subject to any disclaimer, the term of this patent is extended or adjusted under 35 U.S.C. 154(b) by 122 days.

(21) Appl. No.: 12/214,034

(22) Filed: Jun. 16, 2008

(65) Prior Publication Data

US 2009/0309401 A1 Dec. 17, 2009

(51) Int. Cl.
*A47C 3/02* (2006.01)
*A47D 9/04* (2006.01)

(52) U.S. Cl. ..... 297/260.2; 5/108; 5/109

(58) Field of Classification Search ..... 297/260.2; 5/108, 109
See application file for complete search history.

(56) References Cited

U.S. PATENT DOCUMENTS

| | | | | |
|---|---|---|---|---|
| 3,653,080 | A * | 4/1972 | Hafele | 5/108 X |
| 3,992,731 | A | 11/1976 | Carswell | |
| 4,500,133 | A | 2/1985 | Nakao et al. | |
| 4,616,824 | A | 10/1986 | Quinlan, Jr. et al. | |
| 4,656,680 | A * | 4/1987 | Wilson | 5/108 X |
| 4,722,521 | A | 2/1988 | Hyde et al. | |
| 4,785,678 | A | 11/1988 | McGugan et al. | |
| 4,940,229 | A | 7/1990 | Foster | |
| 5,052,749 | A | 10/1991 | Groenendijk | |
| 5,322,343 | A | 6/1994 | Parker et al. | |
| 5,376,053 | A | 12/1994 | Ponder et al. | |
| 5,378,196 | A | 1/1995 | Pinch et al. | |
| 5,588,164 | A | 12/1996 | Proulx | |
| 6,339,304 | B1 | 1/2002 | Allison et al. | |
| 6,361,446 | B2 | 3/2002 | Lawson et al. | |
| 6,824,473 | B2 | 11/2004 | Wu | |
| 6,908,398 | B1 | 6/2005 | Kang | |
| 7,037,205 | B1 | 5/2006 | Bowman | |
| 7,258,617 | B2 | 8/2007 | Chen | |
| 7,258,619 | B2 | 8/2007 | Tuckey | |
| 7,485,086 | B2 * | 2/2009 | Dickie | 600/28 |
| 7,551,100 | B1 * | 6/2009 | Salley et al. | 5/108 X |

* cited by examiner

*Primary Examiner*—Anthony D Barfield
(74) *Attorney, Agent, or Firm*—Mastrogiacomo PLLC

(57) ABSTRACT

An infant seat rocker includes a base member having a pair of rails that protrude generally vertically from the base member and extend a length of the base member, a front wall that protrudes at an angle from the front of the base member, at least one rear wall that protrudes at an angle from the rear of the base member, a motor that is positioned on the base member and a spring that attaches the motor to the infant seat. The infant seat is positioned on the base member and the rails, the front wall and at least one rear wall are capable of locating the infant seat on the base member while the motor is energized to produce and maintain a rocking motion in the infant seat.

19 Claims, 13 Drawing Sheets

INFANT SEAT ROCKER

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to an infant seat rocker and, more particularly, to a mechanized seat rocker that may be easily connected to and safely secure an infant seat while inducing and maintaining a gentle rocking motion in the seat.

2. Background Art

There have been a number of devices that have been developed to rock or sway an infant or baby so that the soothing motion may settle or even help the infant or baby to fall sleep. Most notably, rocking cribs have been used for many numbers of years to soothingly rock infants. Cribs are generally sized to allow the infant to stretch out and provide the infant a full range of motion while sleeping. They are large and often are difficult to move. Although cribs can be rocked easily and aid greatly in soothing a baby and helping the baby to fall asleep, because of its size, a crib may be very difficult to travel with each time the family leaves the home for any extended period and, therefore, may be infeasible for the family to rely on a crib for rocking the baby outside the home.

The rocking motion of rocking chairs has also been used as a means of soothing an infant. The gentle rocking motion of a chair while a baby rests in its mother's arms has been used to soothe and help the baby to sleep for many years. As with cribs, rocking chairs are often large and difficult to move easily. Rocking chairs may also be hard to travel with and often times a rocking chair may not be available when a baby becomes agitated. Often a rocking chair may be too large and without enclosures for safely securing a baby while the chair is in a rocking motion. Adults or other responsible individual are needed to safely hold an infant while seated in a rocking chair, thus taking time away from the adult or other individual that could be spent elsewhere.

Swings have been developed to comfortably secure an infant while swinging or rocking the infant. These swings may be rocked manually by a capable individual or theses swings may also be fashioned with a motor or mechanized winding system such that the swing may operate automatically for a period of time. While these swings work well at home, they too are often large pieces and may be difficult and cumbersome to travel with and troublesome to take on short trips to a store or restaurant.

With the advent of infant/child automobile safety seat laws, a number of infant seats have been developed to protect the infant in a vehicle. A number of advances have been made since the first infant seats for vehicles were introduced some years ago. For example, many infant seats have been developed that may have an outer shell with common locating and attaching points so that the seat may be adapted for many different uses. The same seat may be used to secure an infant in a vehicle to a base, used to carry an infant, used to secure an infant in a stroller, or used to place an infant in a swing. Often these infant seats will have a rounded bottom for fitting into a base or stroller to facilitate ease of insertion and removal of the infant seat.

Still another use for the infant seat is to use this same rounded bottom feature for manually rocking the infant in the seat. Often, the mother or other responsible individual may rock the seat manually by placing the seat on the floor and using their hand or foot to rock the seat. While manual rocking of the seat may be helpful in soothing the infant when a crib, chair or swing is not available, the individual may tire or may not be able to maintain a constant rhythmic motion of the seat which may interrupt the soothing aspects of rocking and ultimately disturb the infant.

Therefore, a need exists for an infant seat rocker that is cable of accepting any number of infant seat designs and that can mechanically and consistently rock the seat when the infant is secured in the infant seat. Furthermore, there is also a need for an infant seat rocker that is compact in size, easy to travel with and may be easily set up such that the infant may seamlessly move to a consistent and soothing rocking motion relatively quickly, while providing a level of safety for the seat and the infant.

SUMMARY OF THE INVENTION

In accordance with the present invention, an infant seat rocker is provided that includes a base member having a pair of rails that protrude generally vertically from the base member and extend a length of the base member, a front wall that protrudes at an angle from the front of the base member, at least one rear wall that protrudes at an angle from the rear of the base member, a motor that is positioned on the base member and a spring that attaches the motor to the infant seat. The infant seat is positioned on the base member and the rails, the front wall and at least one rear wall are capable of locating the infant seat on the base member while the motor is energized to produce and maintain a rocking motion in the infant seat.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
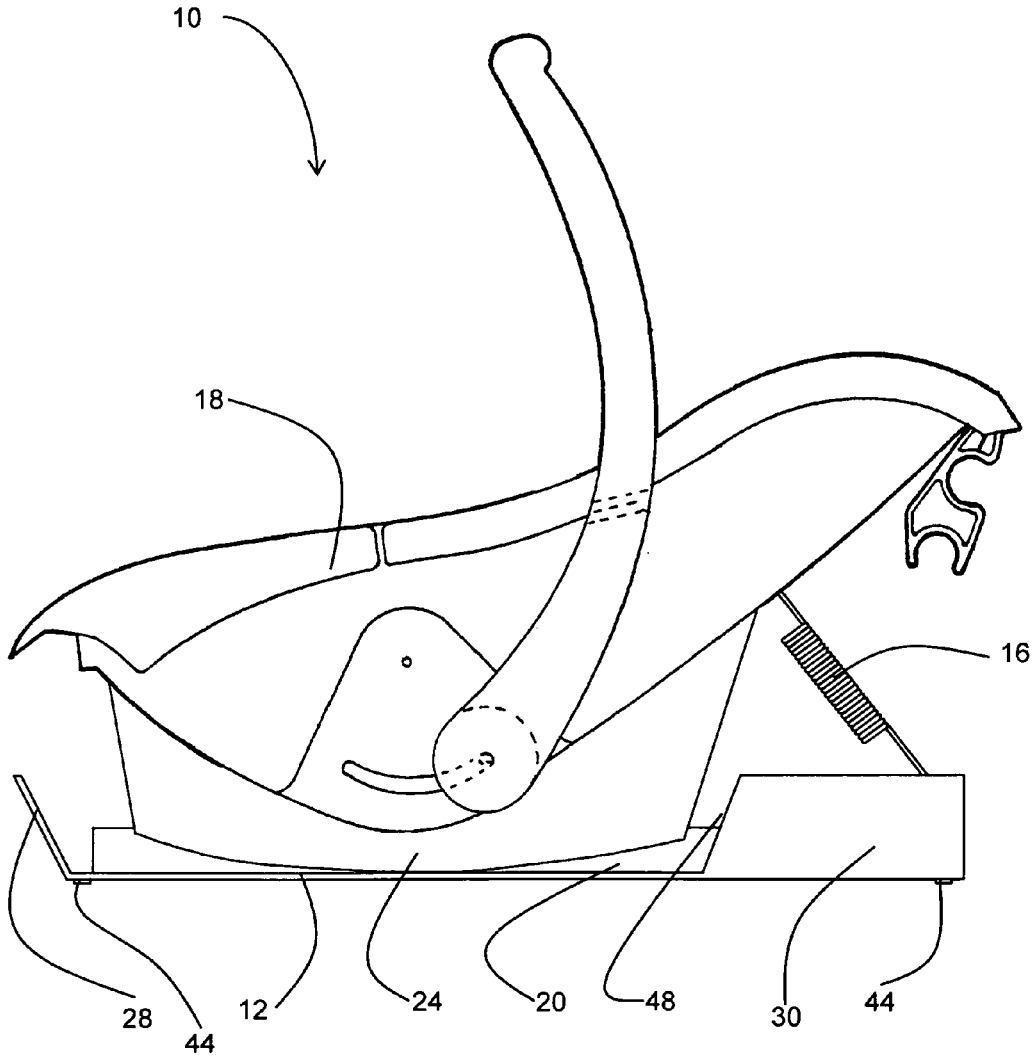
FIG. 1 is a side view of an infant seat rocker according to an embodiment of the present invention.
Figure 2:
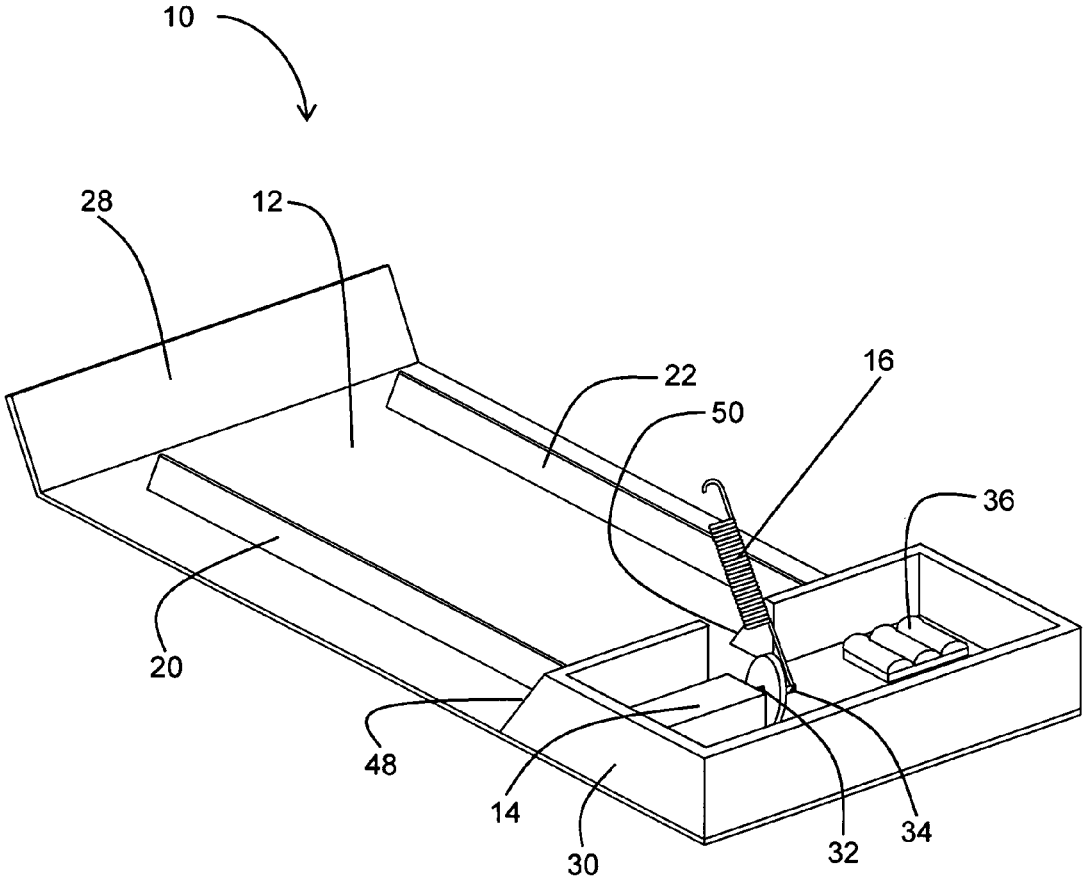
FIG. 2 is a perspective view of an infant seat rocker according to an embodiment of the present invention.
Figure 3:
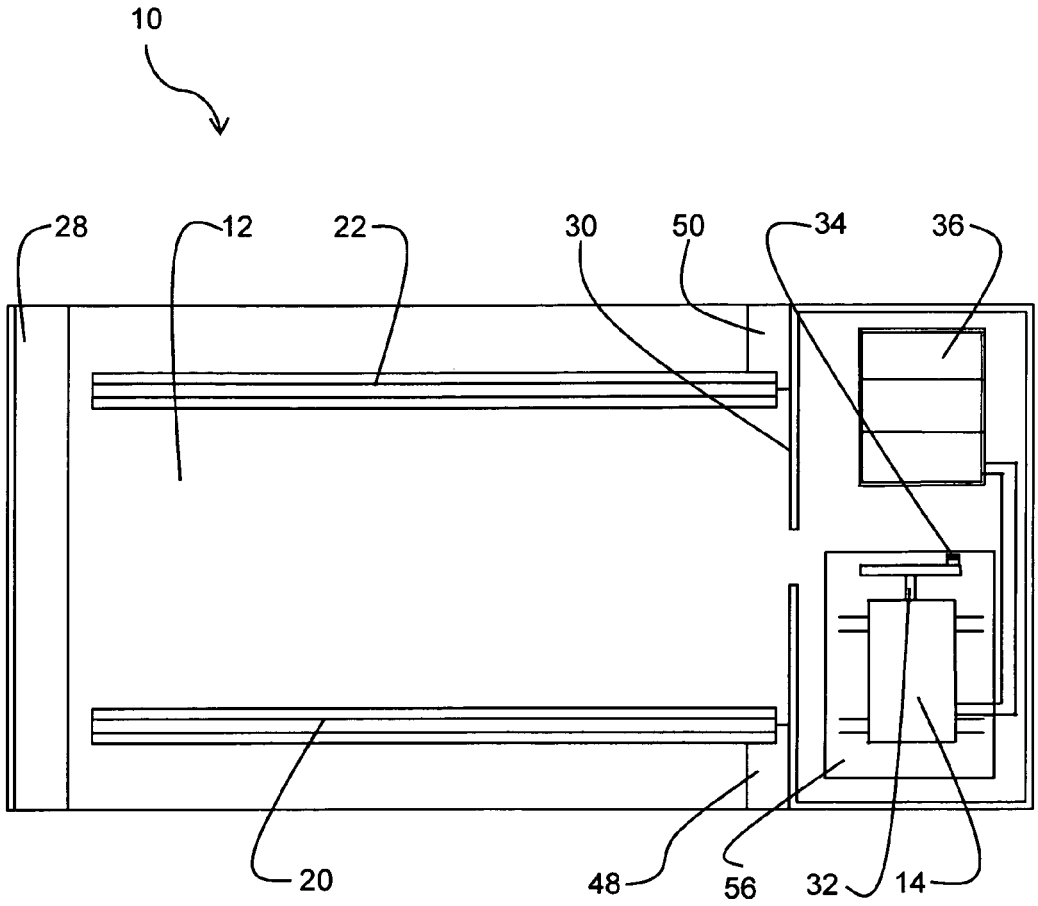
FIG. 3 is a top view of an infant seat rocker according to an embodiment of the present invention.

Referring now to the drawings, a preferred illustrative embodiment of the present invention is shown in detail. Although the drawings represent an embodiment of the present invention, the drawings are not necessarily to scale and certain features may be exaggerated to better illustrate and explain the present invention. Further, the embodiment set forth herein is not intended to be exhaustive or otherwise to limit or restrict the invention to the precise forms and configurations shown in the drawings and disclosed in the following detailed description.

An infant seat rocker 10 is illustrated in FIGS. 1-4 and includes a support base member 12, motor 14 and a spring 16. Base member 12 includes a pair of rails 20 and 22 that protrude vertically from base 12 and extend a length of base 12. Rails 20 and 22 are positioned on base 12 such that a pair of truss members 24 and 26 of an infant seat 18 may be located and positioned on base 12. Base member 12 also includes a front wall 28 that extends from base 12 at an angle from the front of base 12 that allows for uninterrupted rocking of infant seat 18 on base 12 yet still captures infant seat 18 on base 12 if the seat were to slide forward on base 12. Support base member 12 further includes a housing 30 positioned at the rear of base 12 for enclosing motor 14 and power supply 36. Base member 12 also includes rear walls 48 and 50 that extend at an angle near the rear of base member 12. Rear walls 48 and 50 also act to prevent infant seat 18 from sliding too far rearward on base 12. In another embodiment of the present invention, rear walls 48 and 50 may also be included as a portion of housing 30. Rubber feet 44 are included and attached to the bottom of base 12 at at least the four corners. Rubber feet 44 increase the friction between rocker 10 and a surface it may rest on to help prevent rocker 10 from sliding on the surface.

Figure 4:
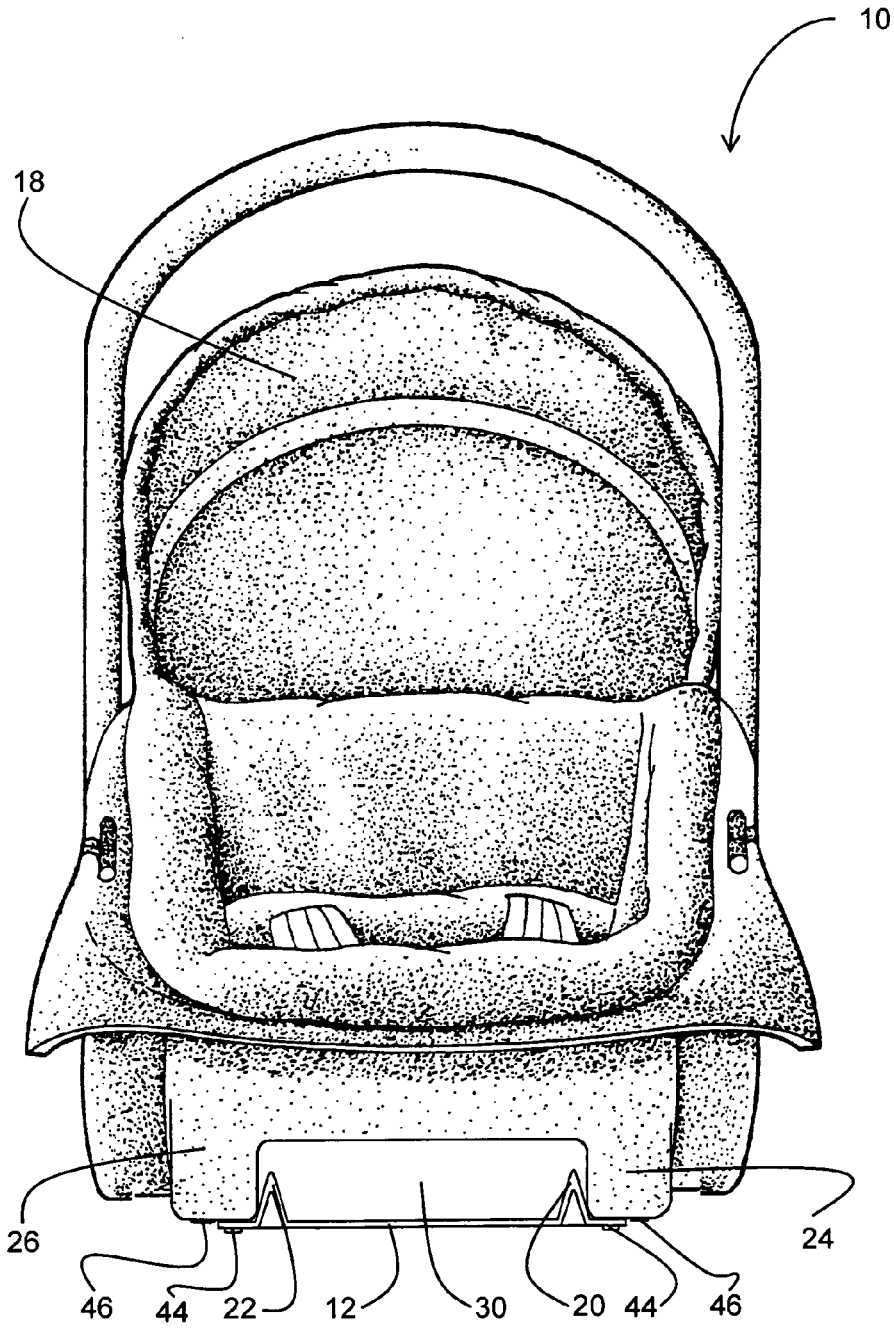
FIG. 4 is a front view of an infant seat rocker according to an embodiment of the present invention.
Figure 5A:
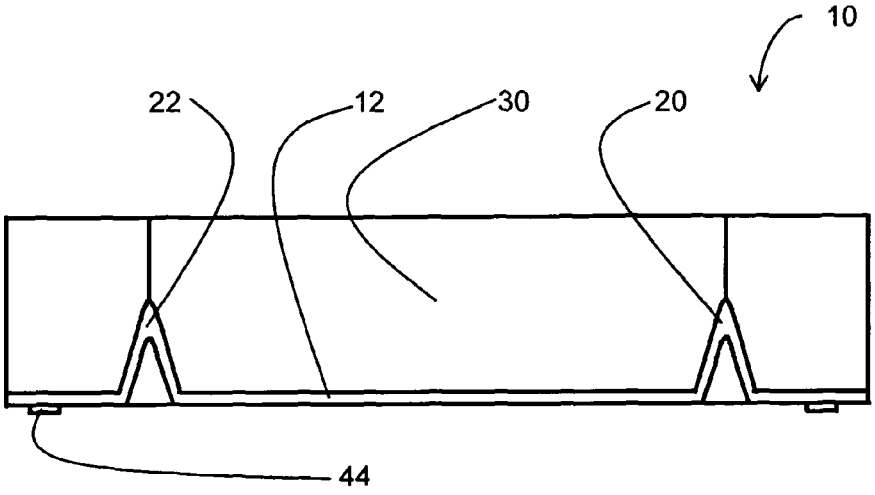
FIG. 5A is a front view of an infant seat rocker according to an embodiment of the present invention.
Figure 5B:
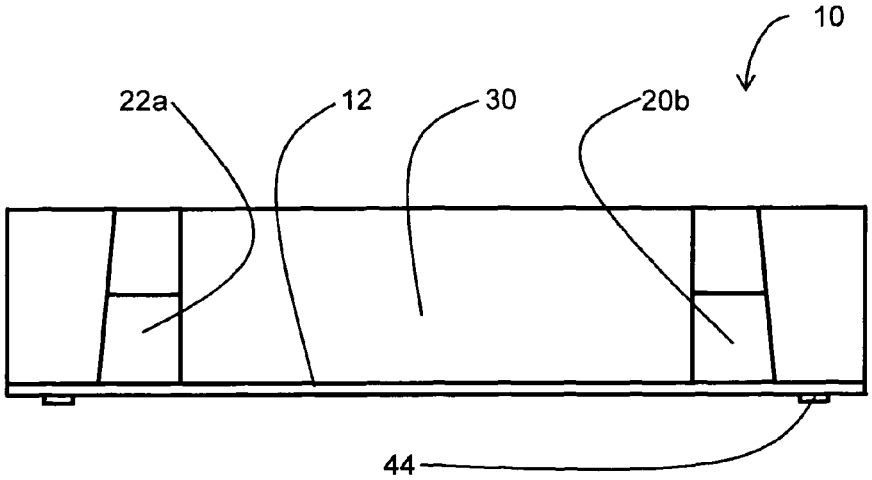
FIG. 5B is a front view of an infant seat rocker according to another embodiment of the present invention.
Figure 6A:
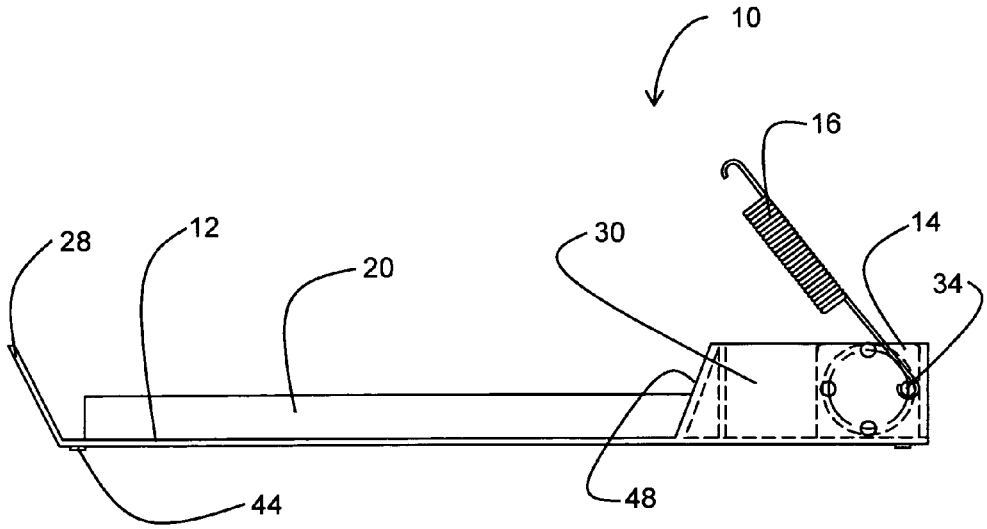
FIG. 6A is a side view an infant seat rocker according to an embodiment of the present invention.
Figure 6B:
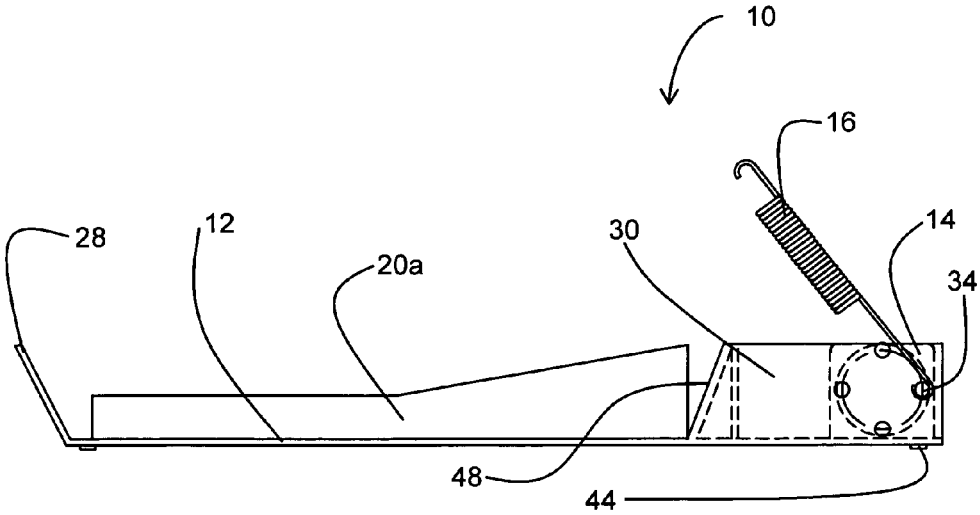
FIG. 6B is a side view an infant seat rocker according to another embodiment of the present invention.

Referring now to FIGS. 2-6B (FIGS. 4, 5A and 5B are shown without front wall 28 to easily illustrate the relationship between infant seat 18 and rocker 10), rails 20 and 22 may be designed such that they protrude vertically from base 12 in a generally triangular shape. The slope angle of rails 20 and 22 is such that infant seat 18 may be easily centered on seat rocker 10. Rails 20 and 22 are positioned on base member 12 to prevent truss members 24 and 26 and infant seat 18 from sliding side to side on seat rocker 10. Seat 18 may be positioned and safely secured on rocker 10 by rails 20 and 22, front wall 28 and rear walls 48 and 50, yet seat 18 may be allowed to rock freely forward and backward. While this particular embodiment of the invention is illustrated with rails 20 and 22 having a triangular shape, it is important to note that rails 20 and 22 may be designed in any shape. FIG. 5B shows a cross section of rails 20*a* and 22*a* having a generally trapezoidal shape.

Rails 20 and 22 may be designed such that the distance between rails 20 and 22 may be adjusted with respect to base member 12 so that infant seats having varying truss widths may be accommodated. A simple dial or slide (not shown) may be positioned on base 12 and secured between rails 20 and 22 and may be used to adjust the distance between rails 20 and 22.

Often the bottom faces of trusses 24 and 26 of various infant seats include a non-skid surface 46 to increase the friction between the seat and the surface it may contact. Typically, the non-skid surface is a strip of rubber that may be applied along the entire face of the truss to prevent the seat from slipping or sliding on a surface. In the current embodiment of the present invention, base 12 of rocker 10 may be designed such that the width of base 12 is slightly less than the width of the non-skid strips secured to each of truss 24 and 26. This will ensure that the hard plastic, low friction surfaces of trusses 24 and 26 will contact the low friction surface of base 12, thus lowing the force and energy needed to produce and maintain the rocking motion of seat 18 with respect to rocker 10.

Motor 14 is preferably a low rotational motor such that a soothing rocking motion may be produced and maintained in seat 18. Motor 14 includes a driveshaft 32 that rotates with the motor. Connected to driveshaft 32 is a spring shaft 34. Spring shaft 34 is the connection point for spring 16 between seat 18 and motor 14. Spring shaft 34 is offset relative to driveshaft 32 of motor 14. The offset of spring shaft 34 relative to motor 14 causes the end of spring 16 to move vertically relative to base 12 when connected at spring shaft 34 and seat 18. This motion will cause a gentle sinusoidal change in the tension force of the spring. The change in tension force is transferred to the back of seat 18 which forces seat 18 into a rocking motion relative to seat rocker 10.

Spring 16 is made of typical steel or comparable materials. The spring constant of spring 16 may be such that seat 18 is in a constant continuous smooth rocking motion relative to seat rocker 10 while motor 14 is in operation. Yet, when motor 14 is powered off, spring shaft 34 may be stopped at any rotational location with respect to motor 14 and spring 16 may be easily detached from seat 18 and seat 18 may be easily removed from seat rocker 10. The low spring constant rate allows for motor 14 to have a low start up torque to prevent jostling the infant when motor 14 is initially engaged and seat 18 begins to rock. Seat 18 will begin to rock gently and slowly increase the angle of rocking motion as motor 14 continues to rotate. The speed of motor 14 may be designed to increase the spring force as seat 18 rocks rearward and decreases the spring force as seat 18 rocks forward. This gentle start of the rocking motion may ensure that the baby remains sleeping when the infant seat is placed in seat rocker 10. Although the operation of the present embodiment has been described using a spring, it is important to note; however, that any type of attaching mechanism may be used to connect seat 18 to motor 14, such as a bar or rod.

Figure 7A:
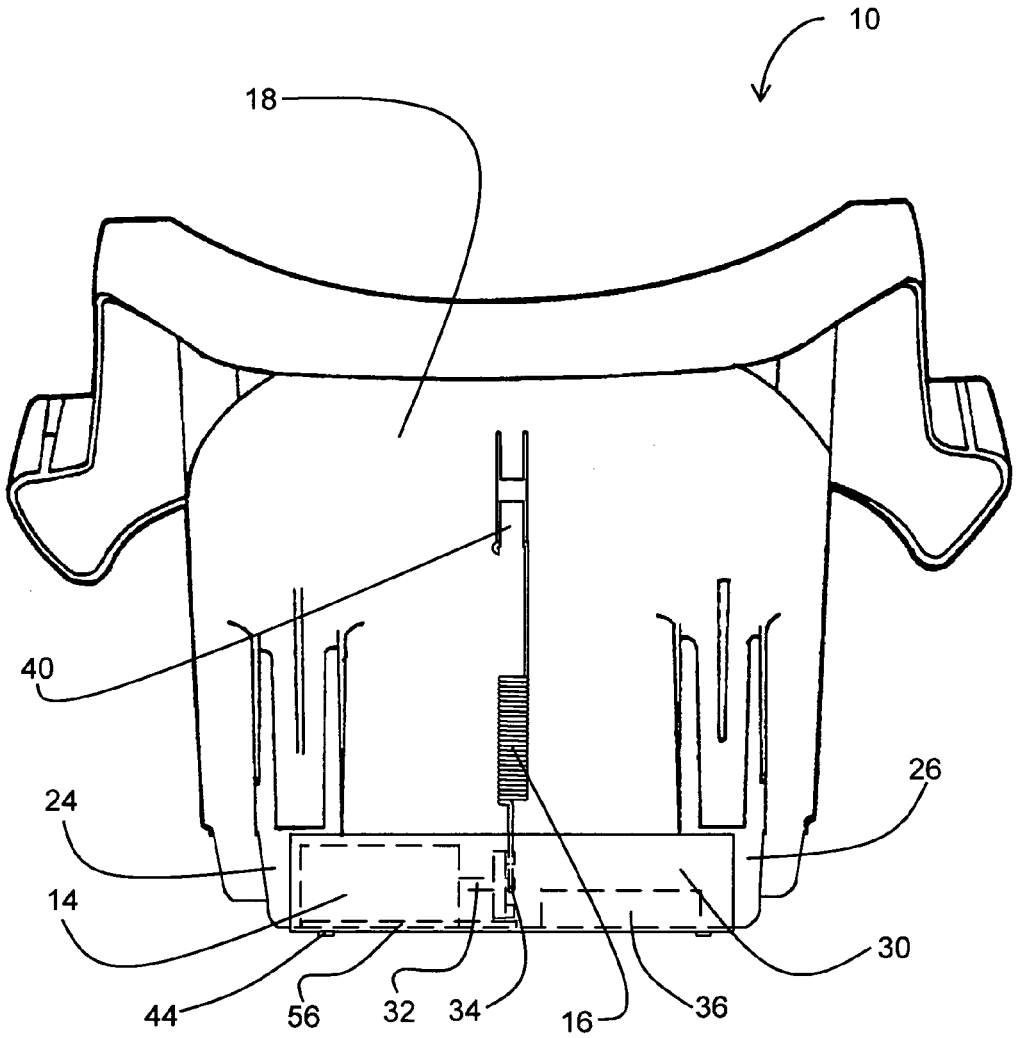
FIG. 7A is a rear view of an infant seat rocker according to an embodiment of the present invention.
Figure 7B:
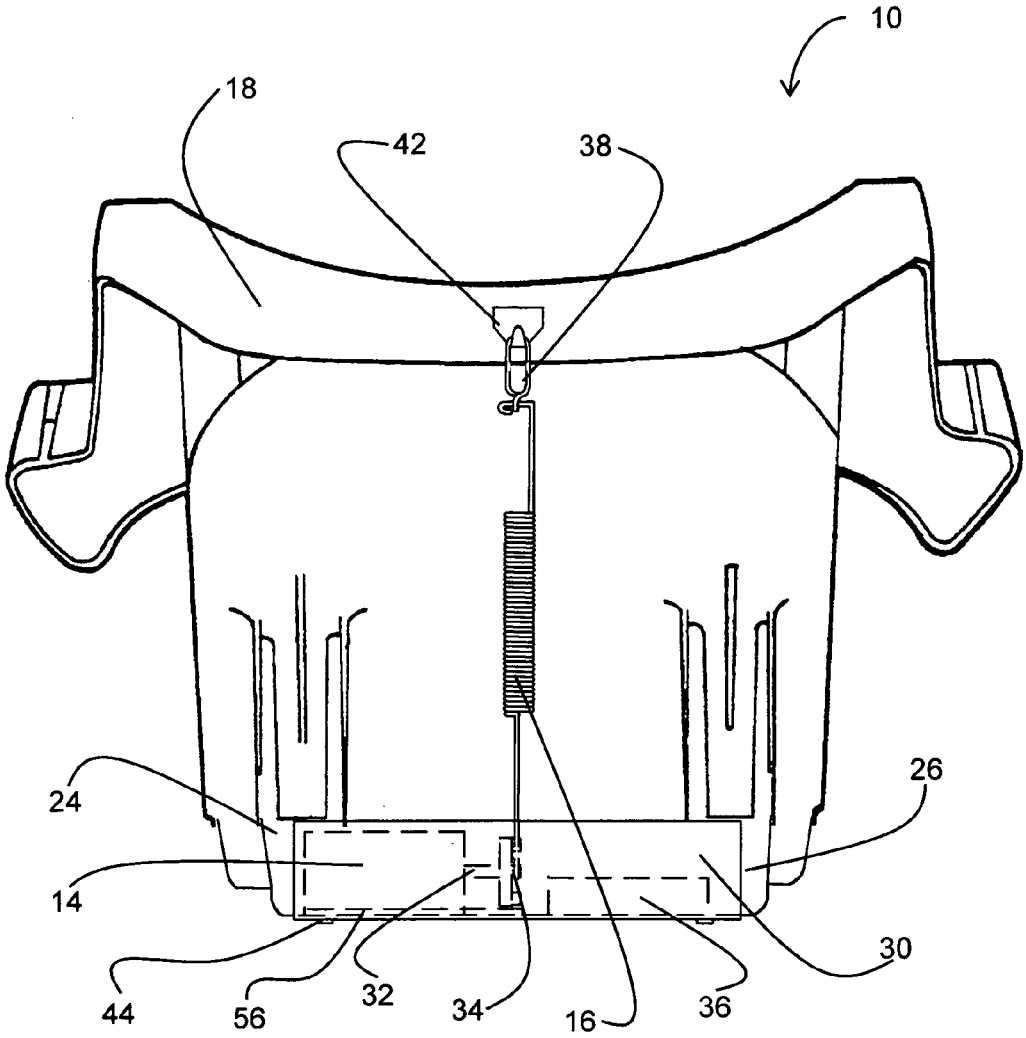
FIG. 7B is a rear view of an infant seat rocker according to another embodiment of the present invention.

FIGS. 7A and 7B illustrate two alternative means to attach spring 16 to seat 18. FIG. 7A shows spring 16 connected directly to seat 18 by using a hook 40 or similar feature that is molded into or secured to seat 18. FIG. 7B shows spring 16 connected to a clip 42 that may be attached to seat 18 by glue, tape or other means. It is important to note; however, that the options for attaching spring 16 to seat 18 described above are merely examples of methods for attaching spring 16 to seat 18 and are by no means exhaustive.

A quick release clasp 38 may be used to connect spring 16 to seat 18 as illustrated in FIG. 7B. In this particular embodiment of the present invention, clasp 18 will ensure a positive connection between seat 18 and spring 16, but will allow for a complete release when an individual removes seat 18 from rocker 10 without first disconnecting spring 16 from seat 18. This will help to ensure the infant is not startled or, more importantly, to ensure that the seat is not damaged or the infant harmed when an individual attempts to remove seat 18 from rocker 10 without first disconnecting spring 16 from seat 18. Although quick release clasp 38 is shown connected between spring 16 and clip 42 in FIG. 7B, it is important to note, however, that quick release clasp 38 will work equally as well with any type of attaching means, such as a bar or rod, any type of feature molded into seat 18, such as hook 40, or feature that is secured to seat 18, such as clip 42.

Figure 9A:
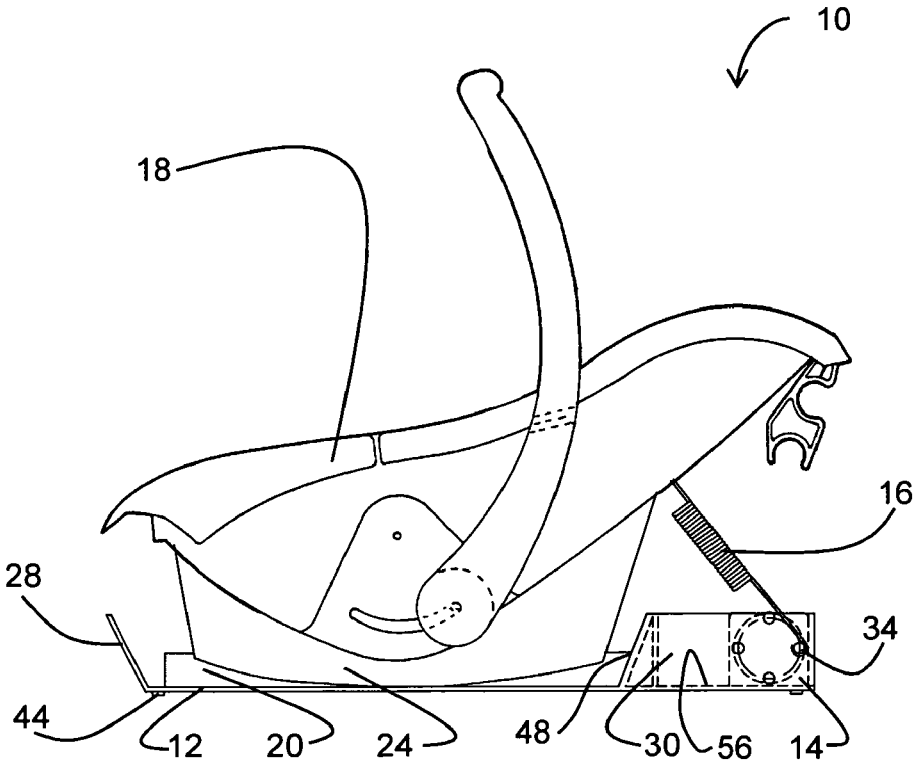
FIGS. 9A and 9B are side views of an infant seat rocker according to an embodiment of the present invention illustrating various positions of a motor.
Figure 9B:
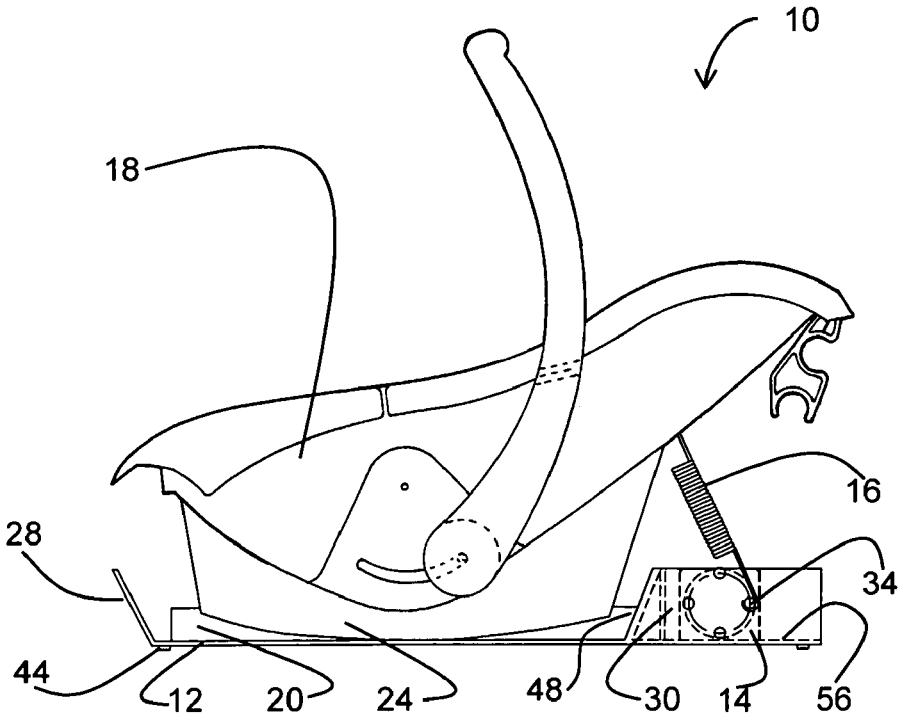

FIGS. 9A and 9B illustrate infant seat rocker 10 having an adjustable motor mounting slide plate 56. Plate 56 may be secured to base member 12 and motor 14 may be secured to plate 56. Plate 56 includes slots that allow motor 14 to be secured in any forward or rearward position relative to base member 12. When motor 14 is positioned forward on plate 56 relative to base 12, the rocking arc of infant seat 18 relative to rocker 10 is reduced. If motor 14 is positioned rearward on plate 56 relative to base 12, the rocking arc of infant seat 18 relative to rocker 10 in increased. The smaller rocking arc may be gentler and thus preferred for smaller infants. The rocking arc may be increased, as described above, as the infant grows older to produce a larger arc.

Figure 8:
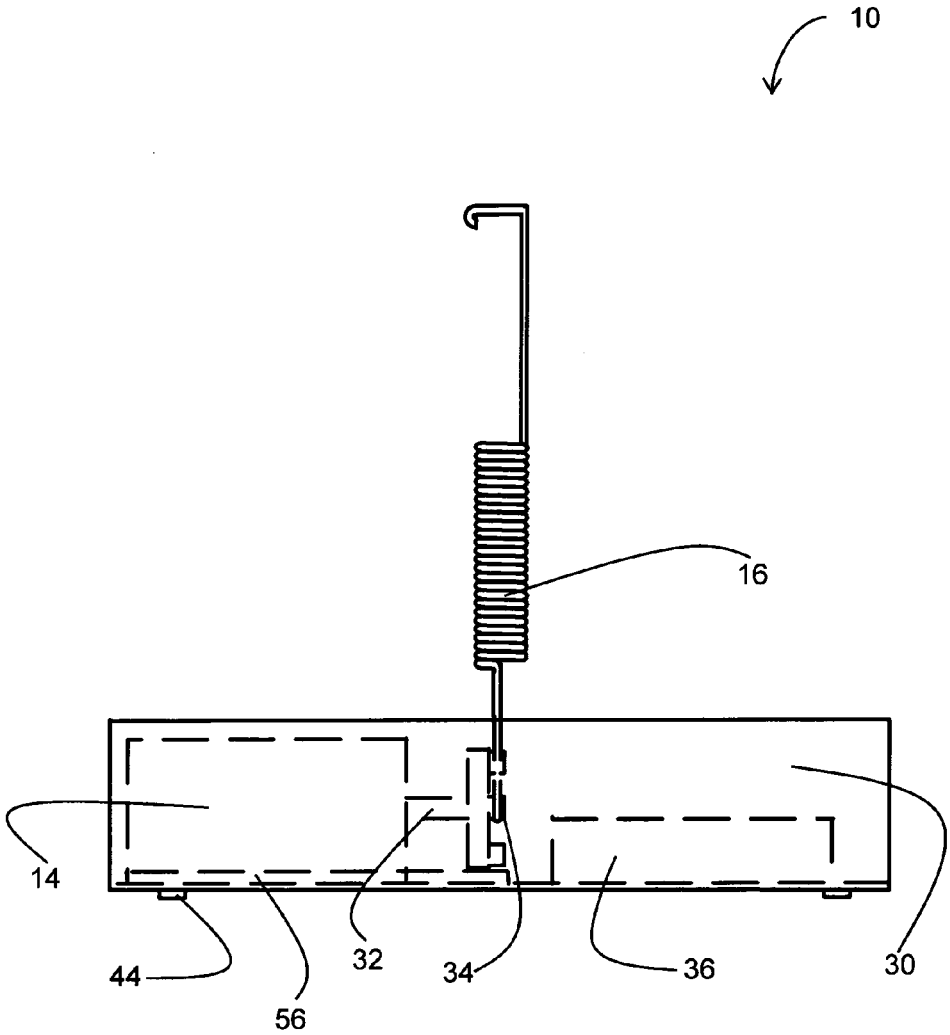
FIG. 8 is a rear view of an infant seat rocker according to an embodiment of the present invention.

Housing 30 is sized to enclose a power supply 36 for motor 14 (see also FIG. 8). The power supply may be of any type suitable to operate motor 14 including batteries or other type of chemical energy. Alternatively, the power supply may also be provided by plugging into a typical wall socket (for example, 110 volt 60 Hz in the United States and 220 volt 50 Hz in many European countries) or vehicle power socket (i e. vehicle cigarette lighter). Still another means of operating rocker 10 may be generated by any typical wind-up, spring-loaded crank that are well known in the art.

Typically, seat rocker 10 may be manufactured of any type of plastic. A plastic material may be used when weight and ease of carrying seat rocker 10 is a consideration. Also, plastic or other materials that exhibit low friction forces may be used. The use of low friction materials may aid in sustaining a comfortable continuous rocking motion so as not to disturb the infant and to reduce the drag on motor 14 thus reducing operating costs of seat rocker 10. Specific types of plastics, such as polyethylene or polypropylene, may also reduce friction between infant seat 18 and seat rocker 10. While this particular embodiment has been described with plastic as a material for use in manufacturing seat rocker 10, it is important to note, however, that seat rocker 10 may be manufactured of any type of metal to further enhance durability of seat rocker 10 or any type of wood to add further decorative enhancements to seat rocker 10. Also, any combination of materials may be used to manufacture seat rocker 10.

Figure 10A:
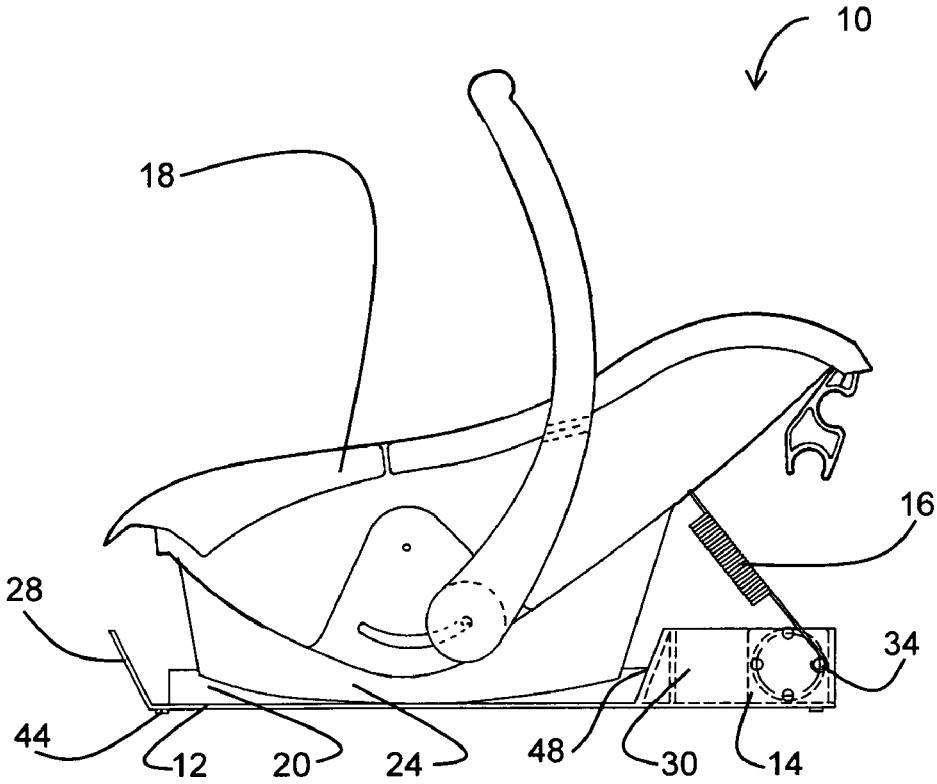
FIGS. 10A-10D are side views of an infant seat rocker according to an embodiment of the present invention illustrating various positions of an infant seat relative to the infant seat rocker.
Figure 10B:
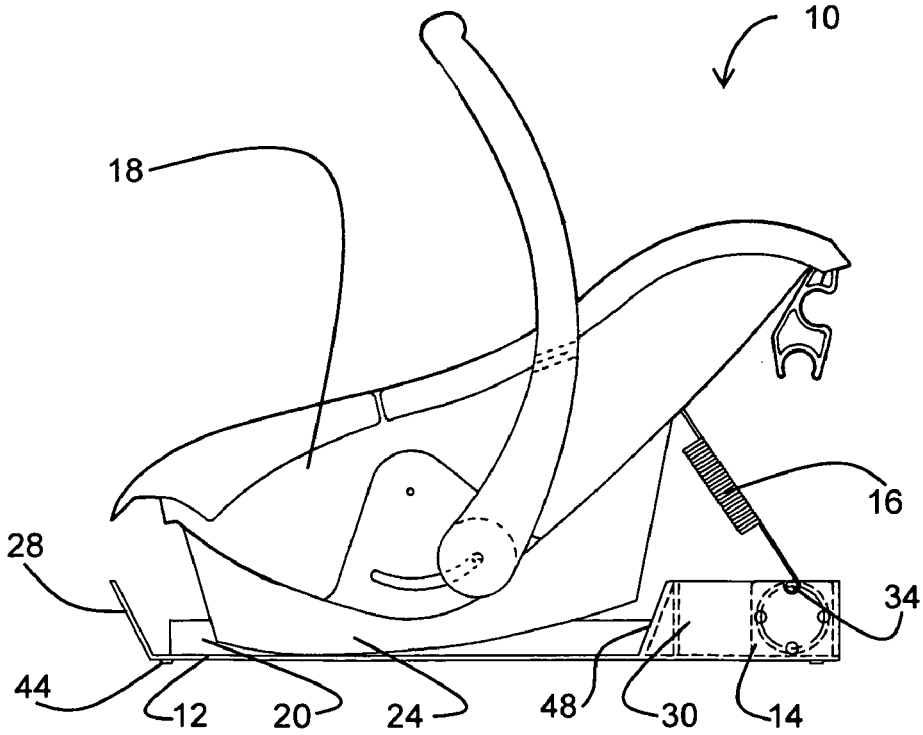
Figure 10C:
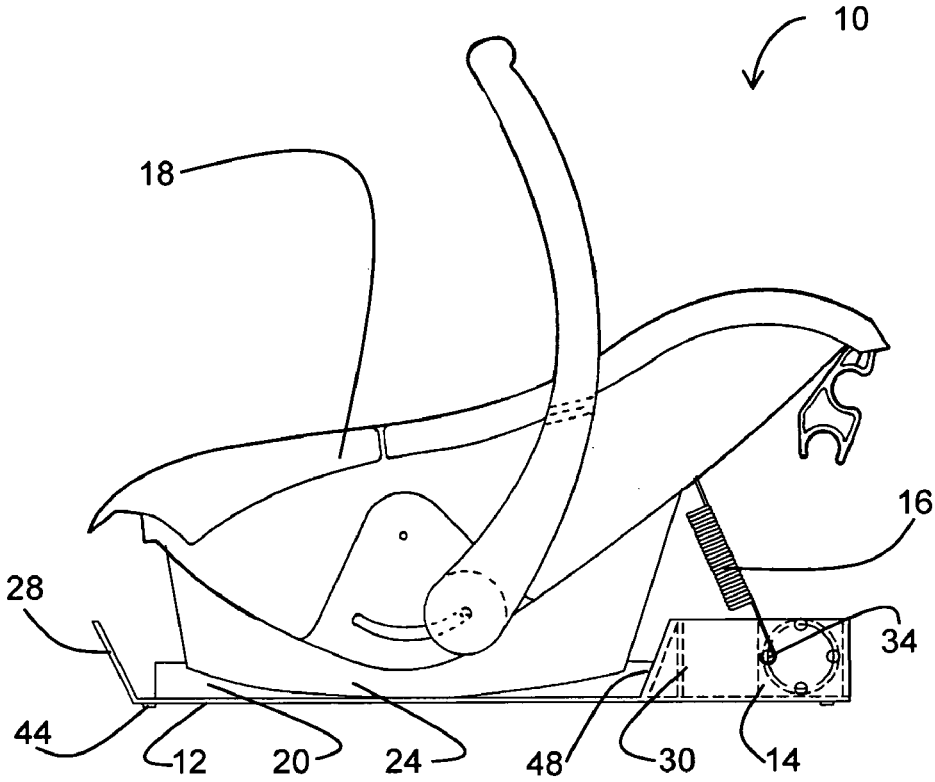
Figure 10D:
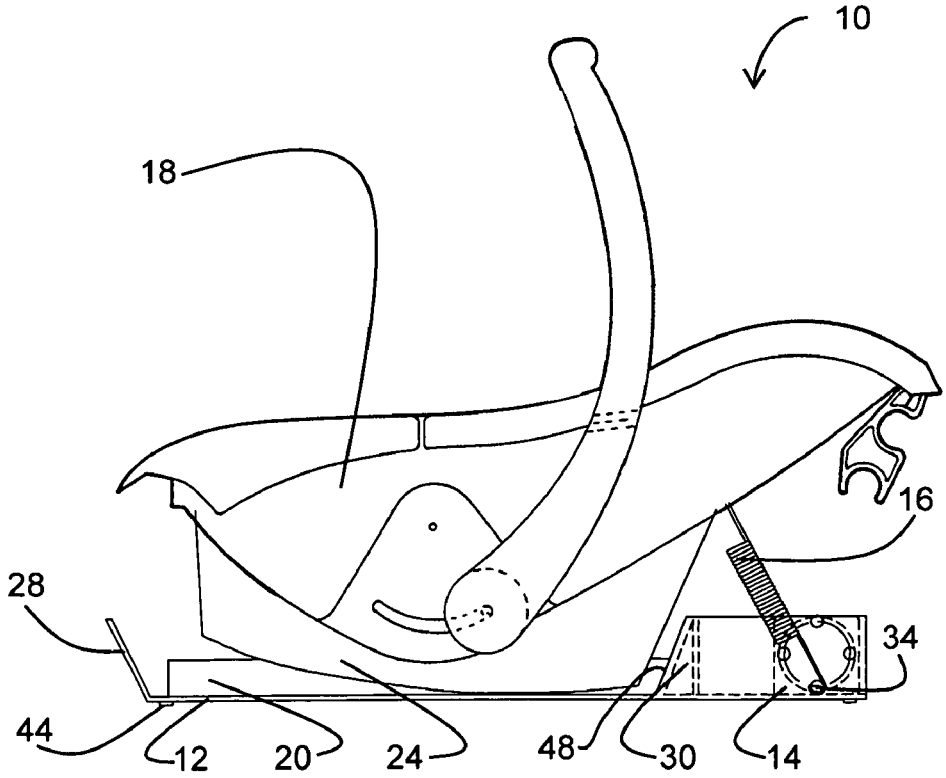

Referring now to FIGS. 10A-10D, infant seat 18 is showing in 3 different positions relative to infant seat rocker 10. FIGS. 10A and 10C illustrate infant seat 18 in a generally level position relative to seat rocker 10. Spring 16 is connected to a point on spring shaft 34 that is generally level or parallel to support base 12 showing infant seat 18 in a generally level position relative to base 12 of rocker 10. FIG. 10B illustrates infant seat 18 in a tilted forward position relative to rocker 10. Spring 16 has now been pushed upward by spring shaft 34, which in turn has tilted seat 18 forward. FIG. 10D illustrates infant seat 18 in a tilted rearward position relative to rocker 10. Spring 16 has now been pulled downward by spring shaft 34, which in turn has pulled or tilted seat 18 rearward. It is important to note, however, FIGS. 10A-10D are merely illustrative of the possible positions and relationships of seat 18, rocker 10, spring 16 and spring shaft 34 and that seat 18 may be in any position relative to rocker 10.

Figure 11A:
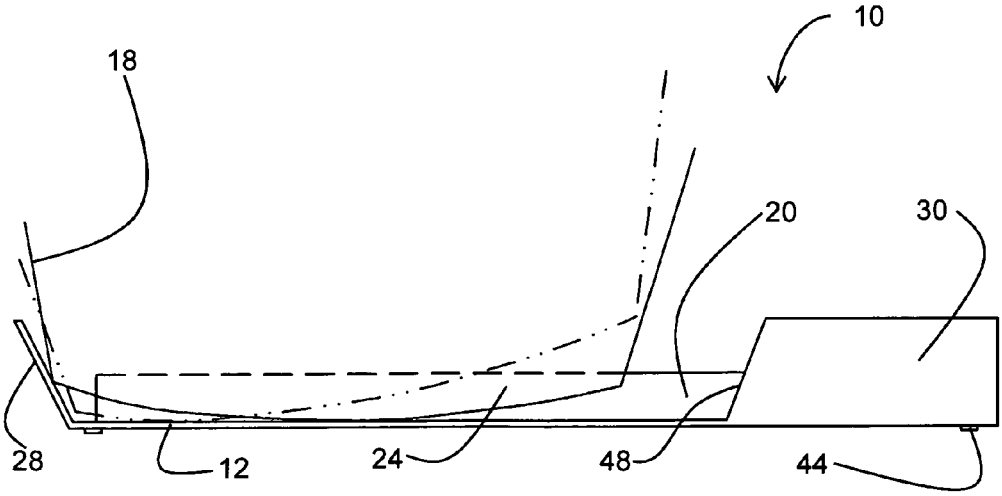
FIGS. 11A-11C are side views of an infant seat rocker according to an embodiment of the present invention illustrating the locating aspects of the infant seat rocker.
Figure 11B:
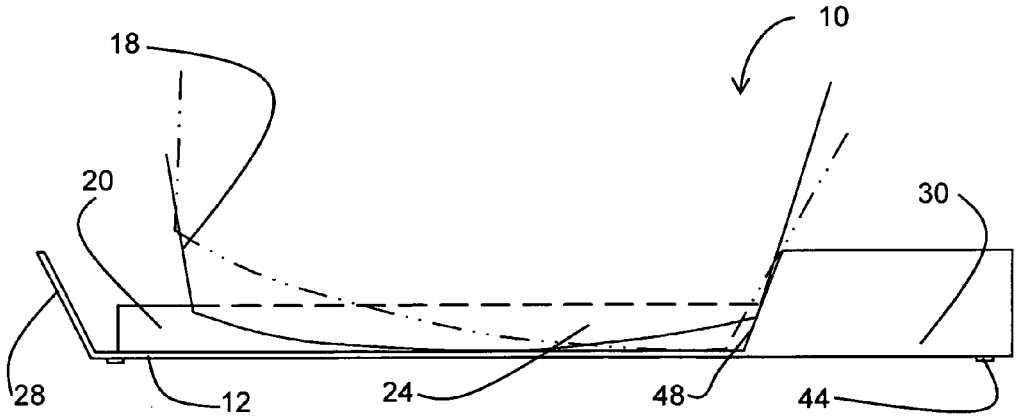
Figure 11C:
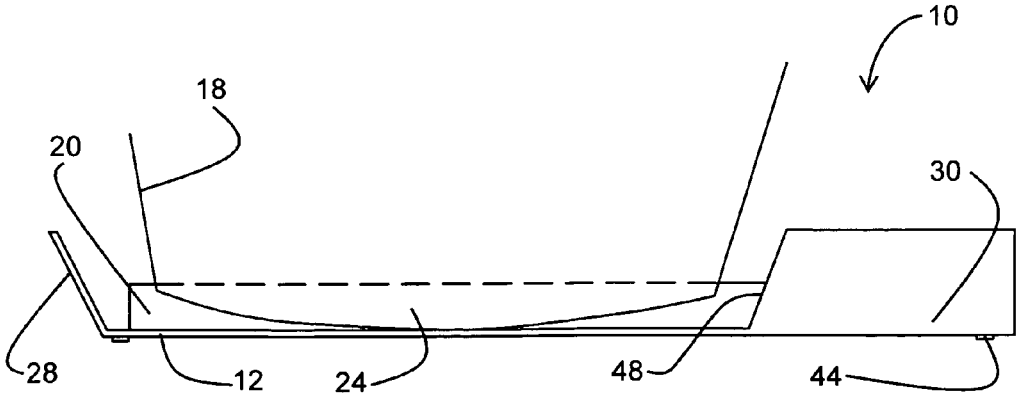

FIGS. 11A-11C illustrate how seat 18 may be placed at any position on base 12 of rocker 10. FIG. 11A shows a depiction of seat 18 that may have been placed too far forward against front wall 28. Seat 18, when set in this position, will not be able to rock freely on base 12. A small downward force on infant seat 18 when placed on base 12 against front wall 28 will force infant seat 18 to center itself with respect to base 12, as illustrated in FIG. 11C, so that seat 18 may rock freely on base 12. FIG. 11B shows a depiction of seat 18 that may have been placed too far rearward against rear walls 48 and 50 of housing 30. As discussed above, seat 18, when set in this position, will not be able to rock freely on base 12. A small downward force on infant seat 18 when placed on base 12 against housing 30 will force infant seat 18 to center itself with respect to base 12, as illustrated in FIG. 11C, so that seat 18 may rock freely on base 12.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. An infant seat rocker comprising:

a base member, including a pair of rails, said pair of rails protrude generally vertically from said base member and extend a length of said base member;

a front wall that protrudes at an angle from the front of said base member;

at least one rear wall that protrudes at an angle from the rear of said base member;

a motor, said motor being positioned on said base member;

means for attaching said motor to an infant seat, said attaching means being a spring;

whereas the infant seat is positioned on said base member, said rails, said front wall and said at least one rear wall capable of locating the infant seat on said base member; and whereas said motor is energized to produce and maintain a rocking motion in the infant seat.

2. The infant seat rocker as recited in claim 1, further including a power supply.

3. The infant seat rocker as recited in claim 2, wherein said power supply is at least one battery.

4. The infant seat rocker as recited in claim 2, wherein said power supply is adapted to draw power from a standard electrical wall socket.

5. The infant seat rocker as recited in claim 2, wherein said power supply is adapted to draw power from a standard vehicle power outlet.

6. The infant seat rocker as recited in claim 2, wherein said power supply is a wind-up mechanism.

7. The infant seat rocker as recited in claim 2, wherein said base member further includes a housing, said housing sized to safely secure said motor and said power supply.

8. The infant seat rocker as recited in claim 1, wherein said pair of rails are adjustable about said base to vary the distance between said rails.

9. The infant seat rocker as recited in claim 1, further including a plate, said motor being mounted to said plate and said motor being slidably adjustable about said plate relative to said base member.

10. The infant seat rocker as recited in claim 1, further including a quick release clasp to connect said attaching means to the infant seat.

11. An infant seat rocker comprising:

a base member including a pair of rails, said pair of rails protrude generally vertically from said base member and extend a length of said base member;

a front wall that protrudes at an angle from the front of said base member;

at least one rear wall that protrudes at an angle from the rear of said base member;

a motor, said motor being positioned on said base member;

a power supply, said power supply connected to said motor;

a housing, said housing positioned at the rear of said base member and sized to safely secure said motor and said power supply;

a plate, said motor being mounted to said plate and said motor being slidably adjustable about said plate relative to said base member;

means for attaching said motor to an infant seat;

whereas the infant seat is positioned on said base member, said rails, said front wall and said at least one rear wall capable of locating the infant seat on said base member; and whereas said motor is energized to produce and maintain a rocking motion in the infant seat.

12. The infant seat rocker as recited in claim 11, wherein said attaching means is a spring.

13. The infant seat rocker as recited in claim 11, wherein said attaching means is a rod.

14. The infant seat rocker as recited in claim 11, wherein said power supply is at least one battery.

15. The infant seat rocker as recited in claim 11, wherein said power supply is adapted to draw power from a standard electrical wall socket.

16. The infant seat rocker as recited in claim 11, wherein said power supply is adapted to draw power from a standard vehicle power outlet.

17. The infant seat rocker as recited in claim 11, wherein said power supply is a wind-up mechanism.

18. The infant seat rocker as recited in claim 11, wherein said pair of rails are adjustable about said base member to vary the distance between said rails.

19. The infant seat rocker as recited in claim 11, further including a quick release clasp to connect said attaching means to the infant seat.

* * * * *